United States Patent [19]

Zacharin

[11] 4,159,680

[45] Jul. 3, 1979

[54] RANDOM DELAY TIMER

[75] Inventor: Alexey T. Zacharin, Parsippany, N.J.

[73] Assignee: The United States of America as represented by the Secretary of the Army, Washington, D.C.

[21] Appl. No.: 901,876

[22] Filed: May 1, 1978

[51] Int. Cl.[2] ..... F42C 9/06

[52] U.S. Cl. ..... 102/277

[58] Field of Search ..... 102/277, 276, 228

[56] References Cited

U.S. PATENT DOCUMENTS 2,334,182 11/1943 Farrow ..... 102/277

2,977,883 4/1961 Czajkowski ..... 102/277

*Primary Examiner*—Charles T. Jordan

*Attorney, Agent, or Firm*—Nathan Edelberg; A. Victor Erkkila; Costa Perchem

[57] ABSTRACT

A fuzing device for a submunition or munition comprises an airtight housing containing a pressure chamber communicating through an orifice to a diaphragm with a firing pin attached thereto. The fuze is actuated by pressurizing the chamber with gas which flows through the orifice at a predetermined rate until the total pressure on the diaphragm causes it to deform sufficiently to activate a detonator.

5 Claims, 3 Drawing Figures

RANDOM DELAY TIMER

BACKGROUND OF THE INVENTION

This invention relates to a fuze mechanism and more particularly to a fuze adapted for aerial delivered submunitions which is self arming at a predetermined ambient pressure and it self activating at atmospheric pressure.

In the past, many devices have been provided for actuating fuze mechanisms of various munitions after a predetermined time delay, some being relatively complex. One type of fuze for providing an extended delay period prior to functioning comprises a chamber filled with silicone liquid which provides a timing medium for axially rotated, spring powered paddles. Upon completion of rotation of the paddles, a pre-loaded firing pin is released to fire a detonator. A fuze of this type must be carefully precision machined, hence costly, and is extremely sensitive to temperature and component tolerances. Moreover, the fuze cannont be miniaturized to fit the required geometry for small munitions for submunitions, and its time delay distribution is unacceptable for area targeted submunitions. The fuzing device of this invention eliminates the aforementioned shortcomings and results in a dramatic reduction of malfunctions as well as an increase in fuze reliability and safety.

SUMMARY OF THE INVENTION

Accordingly, an object of this invention is to provide a fuze having a delay timer which is responsive to predetermined pressure changes for effecting detonation of an explosive charge.

Another object of the invention is the provision of a new and improved means for increasing the safety factor of an arming device for an explosive weapon.

It is another object of this invention to provide a delay fuze which is inexpensive to construct, easy to assemble and requiring no elaborate handling or checkout procedures.

Other objects, advantages and novel features of the invention will become apparent from the following detailed description.

The present invention provides a pressure actuated fuze adapted to be stored in a pressurized container for aerial dispersal. The fuze comprises a housing containing a circular flexible diaphgram secured to the housing so as to subdivide the interior of the housing into a pair of separate chambers. The fuze is adapted to be self-armed at a predetermined pressure after it leaves the pressurzied container and to automatically fire at a second lower predetermined pressure. The release of the firing pin by the movement of the diaphragm possesses advantages over the prior arming devices since it will function independently of external forces such as spin, set-back or drag.

DESCRIPTION OF THE PREFERRED EMBODIMENT

Figure 1:
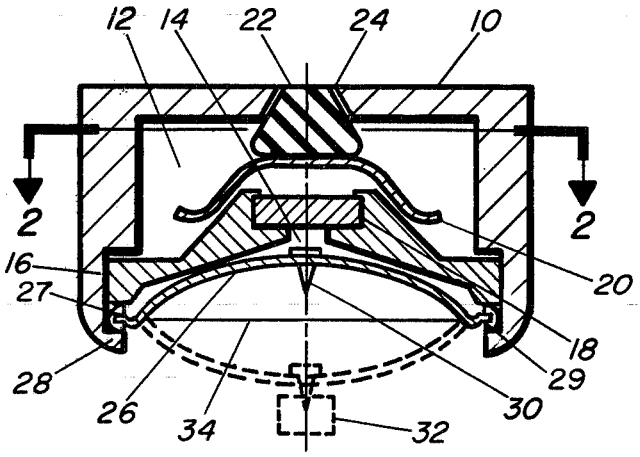
FIG. 1. Is an axial cross-section of a fully assembled delay fuze which is constructed and assembled in accordance with subject invention.
Figure 2:
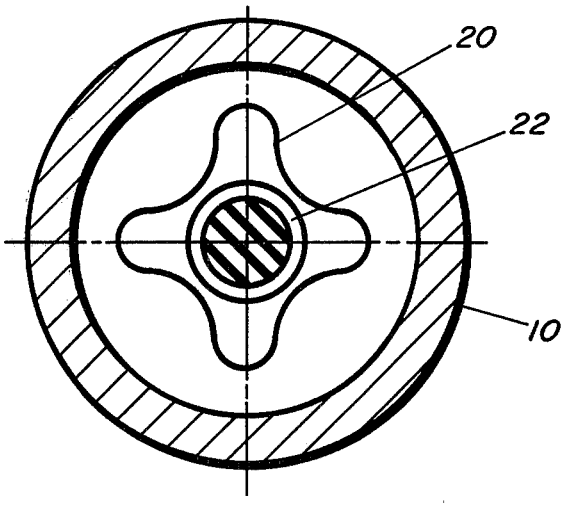
FIG. 2 Is a sectional view along line A—A of the upper portion of the delay fuze.

Referring to FIGS. 1 and 2, the fuze of subject invention is adapted for use in a submunition (not shown) and comprises an airtight housing such as cylindrical housing 10 having a primary chamber 12 and a secondary chamber 14 therein divided by a rigid partition 16 containing a communicating passage between 12 and 14 with metering means therein such as sintered metal orifice 18. Partition 16 is rigidly affixed within housing 10. Located in primary chamber 12 directly above orifice 18 and bearing against partition 16 is a spring 20 which also bears against a generally conical plug 22 so as to force plug 22 into sealing relationship with external pressure port 24 of the housing 10. In the secondary chamber 14 is a generally disc-shaped diaphragm spring 26 which isolates chamber 14 from the external pressure below the spring in FIG. 1. The peripheral edge of the partition 16 and the diaphragm spring 26 together with the seal 27 are secured to housing 10 by mounting in an annular flange 28 of the housing by suitable means such as crimp 29. The diaphragm spring 26 has secured thereto a centrally located firing pin 30 which is utilized to set off the detonator 32 upon activation of the fuze. Spring 26 is preferably of the snap-deformation type having a dome-like shape in its static state, and which abruptly snaps to an oppositely corresponding shape when the total pressure applied to the static spring reaches a predetermined amount.

Figure 3:
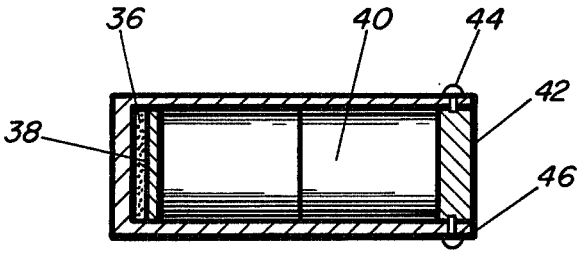
FIG. 3 Is a cross-sectional view of the closed container carrying the explosives.

The submunitions are delivered over the target area in a closed container 46 (see FIG. 3) having an expulsion charge 36 which bears on a pusher plate 38 which pushes the stacked munitions 40 against the end plate 42. This force is sufficient to fail the shear pins 44 that retain the end plate 42, thus ejecting the submunitions into the atmosphere.

Prior to launch the closed container 46 in which the submunitions are stored is air or gas pressurized to 300 psi, resulting in uniform application of this pressure over the entire outside surface of housing 10 in each submunition, and is sufficient to displace plug 22 inwardly against the force of spring 20. This action allows the same 300 psi pressure to enter the primary chamber 12 through external port 24 as long as the pressure in chamber 12 is less than the container 46 internal pressure. As soon as pressure equilibrium is established across port 24 spring 20 will push plug 22 back into pressure port 24 thus capturing a sufficient volume of air or gas to retain the pressure in primary chamber 12. The pressure outside of spring 26 may be atmospheric of any other amount but will be substantially less than the pressure within housing 10, especially after expulsion of the submunitions outside of container 46. Thus, the captured pressure in primary chamber 12 will be metered through the sintered metal orifice 18 into the secondary chamber 14 at a rate depending upon the size and porosity of the orifice element. The amount of metering is controlled by the sintering process used to manufacture the orifice and therefore can be selected so that the pressure buildup in chamber 14 will occur at a desired rate to produce a predetermined time delay interval. As the pressure in the secondary chamber 14 increases, it moves the diaphragm spring 26 toward the snap line 34. As soon as the diaphragm spring 26 reaches the snap line 34 the spring will snap to its inverted position and the firing pin 30 will strike the detonator 32 which was advanced to this position by a safing and arming mechanism.

It should be noted that this design completely eliminates the probability of dangerous duds. For example, if the primary chamber pressurization fails it is not possible to snap the spring and function the detonator even if detonator 32 has been placed in armed position. If the secondary chamber is pressurized prior to arming, and the diaphragm spring snaps, the firing pin will not actuate the detonator if the detonator has not been positioned by proper operation of the safing and arming mechanism.

I wish it to be understood that I do not desire to be limited to the exact details of construction shown as described, for obvious modifications will occur to persons skilled in the art.

I claim:

1. A fuze for a munition, comprising:

an airtight enclosed housing, an internal partition secured within said housing and defining a primary chamber and a secondary chamber on either side of said partition, an external pressure port in said housing communicating with said primary chamber, diaphragm means mounted in said housing for isolating said secondary chamber from external pressure outside said housing and said secondary chamber, said diaphragm means being dependable between a static condition and a pressurized condition, means in said partition for metering gaseous flow from said primary to said secondary chamber, movable seal means operatively related to said external pressure port for releasably communicating said primary chamber to external pressure outside said housing and sealing said port against said pressure, resilient biasing force means bearing against said movable seal means for biasing said movable seal means toward sealing relationship with said external pressure port, and detonation means operatively connected with said diaphragm means for causing detonation of said munition when said diaphragm means is deformed into said pressurized condition.

2. The fuze recited in claim 1 wherein:

said diaphragm means comprises a generally disc-shaped spring capable of snap-deforming between said static condition and said pressurized condition.

3. The fuze recited in claim 2 wherein:

said metering means comprises a scintered metal orifice.

4. The fuze recited in claim 3 wherein:

said movable seal means comprises a conical plug.

5. The fuze recited in claim 4 wherein:

said resilient biasing force means comprises a spring.

* * * * *